US006662877B2

(12) United States Patent
Patel

(10) Patent No.: US 6,662,877 B2
(45) Date of Patent: Dec. 16, 2003

(54) FORMATION ISOLATION VALVE

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 49 days.

(21) Appl. No.: 09/996,146

(22) Filed: Nov. 28, 2001

(65) Prior Publication Data

US 2002/0066573 A1 Jun. 6, 2002

Related U.S. Application Data

(60) Provisional application No. 60/250,754, filed on Dec. 1, 2000.

(51) Int. Cl.[7] ..... E21B 34/14; E21B 34/12; E21B 34/10

(52) U.S. Cl. ..... 166/386; 166/323; 166/331; 166/332.3; 166/374

(58) Field of Search ..... 166/374, 386, 166/321, 323, 331, 240, 334.2, 332.3

(56) References Cited

U.S. PATENT DOCUMENTS

| | | | | |
|---|---|---|---|---|
| 4,403,659 A | * | 9/1983 | Upchurch | 166/374 |
| 5,529,126 A | * | 6/1996 | Edwards | 166/331 |
| 5,810,087 A | | 9/1998 | Patel | 166/373 |
| 5,950,733 A | | 9/1999 | Patel | 166/373 |
| 6,041,864 A | | 3/2000 | Patel et al. | 166/322.4 |
| 6,085,845 A | | 7/2000 | Patel et al. | 166/373 |
| 6,227,298 B1 | | 5/2001 | Patel | 166/321 |
| 6,230,807 B1 | | 5/2001 | Patel | 166/321 |
| 6,276,458 B1 | * | 8/2001 | Malone et al. | 166/386 |

OTHER PUBLICATIONS

Schlumberger, "Formation Isolation Valve (FIV)", p. 1 (Jan. 1997).
Schlumberger, "Liner Top Isolation Valve (LTIV)", p. 1 (date unknown).
Schlumberger, "Formation Isolation Valve (FIV)", p. 1 (Aug. 1997).
Schlumberger, "Linear Top Isolation Valve (LTIV)", p. 1 (Sep. 1997).
Schlumberger, IRIS Operated Dual Valve (IRDV–AB), p. 1, (Oct. 1997).

* cited by examiner

*Primary Examiner*—David Bagnell
*Assistant Examiner*—Brian Halford
(74) *Attorney, Agent, or Firm*—Trop, Pruner & Hu, P.C.; Jeffrey E. Griffin; Brigitte L. Echols

(57) ABSTRACT

An assembly that is usable in a subterranean well includes a valve, a sleeve and an index mechanism. The valve is adapted to selectively isolate a region of the well, and the sleeve is adapted to be moved by a downhole tool to cause the valve to transition from a first state to a second state. The index mechanism prevents the valve from transitioning from the first state to the second state until after a position of the sleeve follows a predefined pattern.

49 Claims, 9 Drawing Sheets

FORMATION ISOLATION VALVE

Pursuant to 35 U.S.C. §119, this application claims the benefit of U.S. Provisional Application Serial No. 60/250,754, entitled FORMATION ISOLATION VALVE," filed on Dec. 1, 2000.

BACKGROUND

The invention generally relates to a formation isolation valve.

A formation isolation valve may be located downhole to form a sealed access to a particular formation. In this manner, the formation isolation valve may be opened or run open so that a tubular string may be run downhole through the valve to permit the string to perform one or more downhole functions below the formation isolation valve. After these functions are complete, the string may be retrieved. After the end of the string passes through the valve during the retrieval of the string, the valve may then be operated to seal off the formation below the valve. In this manner, a shifting tool may be located at the end of the tool to physically engage the valve to cause the valve to close. The shifting tool may also be used to open the valve.

As an example, the string may include a gravel packing tool to route gravel into an annular region that surrounds a screened portion of a production tubing of the well. In this manner, the gravel travels down a central passageway of the string and through radial ports of the gravel packing tool into the annular region. The gravel may include sand that falls between the interior opening of the formation isolation valve and the outside of the string to create friction between the string and the valve. Unfortunately, the friction between the string and valve may cause the string to unintentionally physically engage the valve to cause the valve to prematurely close on the string. Thus, such a scenario may cause the string to become wedged in the valve.

Thus, there is a continuing need for an arrangement that addresses one or more of the problems that are stated above.

SUMMARY

In an embodiment of the invention, an assembly that is usable in a subterranean well includes a valve, a sleeve and an index mechanism. The valve is adapted to selectively isolate a region of the well, and the sleeve is adapted to be moved by a downhole tool to cause the valve to transition from a first state to a second state. The index mechanism prevents the valve from transitioning from the first state to the second state until after a position of the sleeve follows a predefined pattern.

Advantages and other features of the invention will become apparent from the following description, drawing and claims.

DETAILED DESCRIPTION

Figure 1:
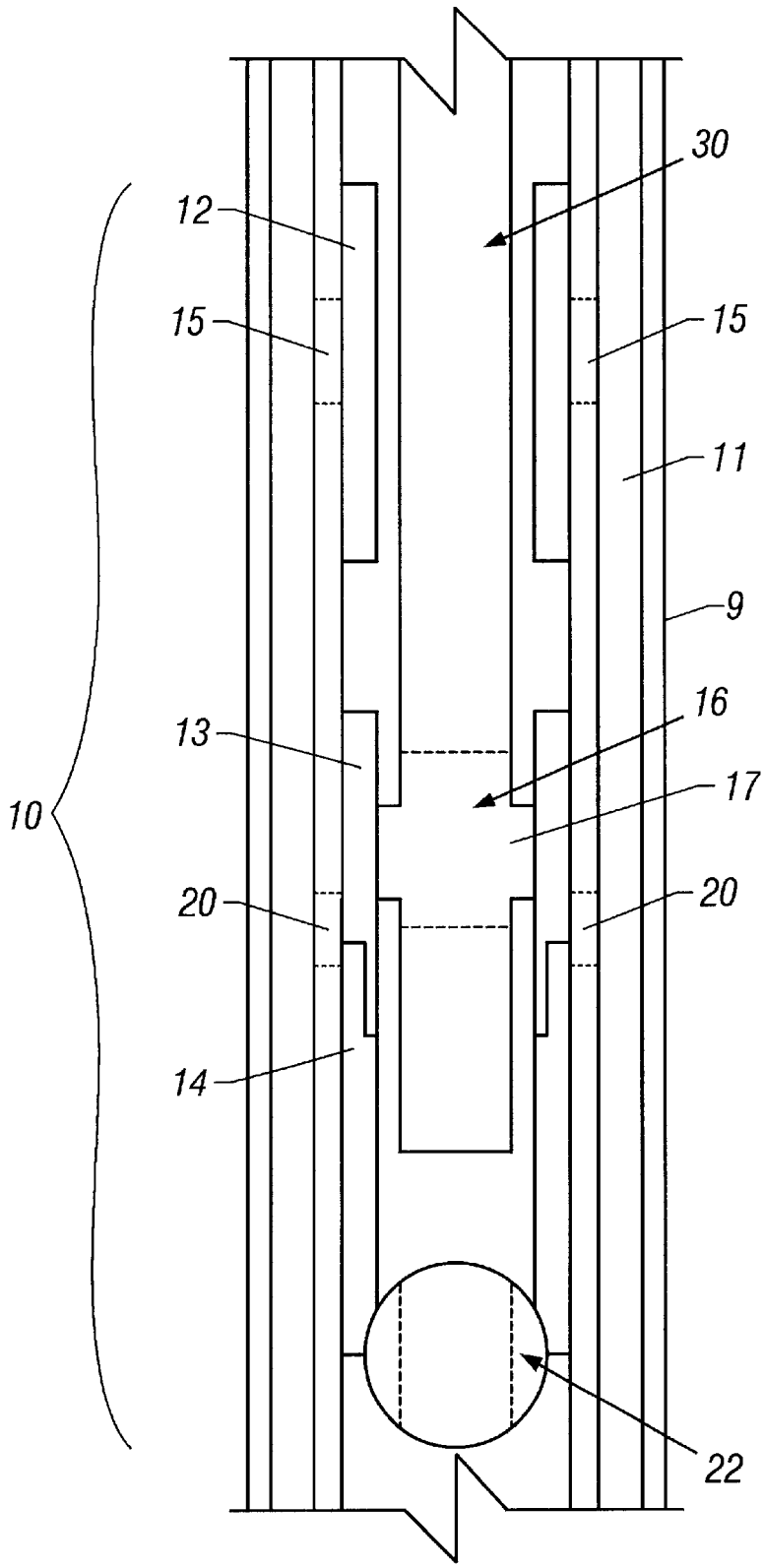
FIG. 1 is a schematic diagram of a formation isolation valve assembly according to an embodiment of the invention.

Referring to FIG. 1, an embodiment 10 of a formation isolation valve assembly in accordance with the invention controls access to a region of a well below the valve 10. In this manner, the valve assembly 10 permits a string, such as a string 30, to pass through the valve assembly 10 to the region beneath the valve assembly 10 when the valve assembly 10 is in an open state (as depicted in FIG. 1), and when the valve assembly 10 is in a closed state, the valve assembly 10 seals off communication with the region beneath the valve assembly 10. An annular region, or annulus 11, that is located between an exterior surface of the valve assembly 10 and a production tubing 9 of the well may be sealed off by a packer (not shown).

More specifically, in some embodiments of the invention, the valve assembly 10 includes a ball valve 22 that assumes an open state to permit the string 30 to pass through the valve assembly 10 and assumes a closed state to seal off the region below the valve assembly 10 when the string 30 no longer extends through the ball valve 22.

In some embodiments of the invention, when the formation isolation valve assembly 10 is first set in place downhole, the ball valve 22 may be opened (or run into the well bore open) to permit the string 30 to pass through. Alternatively, the formation isolation valve assembly 10 may be run with the string 30 already included through the ball valve 22. The string 30 may include a gravel packing tool to perform gravel packing operations downhole. After the gravel packing operations are complete, the string 30 may be withdrawn from the well bore.

In some embodiments of the invention, after the gravel packing operation is complete, the ball valve 22 is closed. In this manner, the string 30 may include a shifting tool 16 (near a lower end of the string 30) to physically close the ball valve 22. More specifically, after lower end of the string 30 is retracted above the ball valve 22, a profiled section 17 of the shifting tool 16 engages (as described below) the valve assembly 10 and is operated in a manner (described below) to cause the ball valve 22 to close.

After the string 30 is withdrawn from the well bore and the gravel packing operations are complete, pressure tests may be conducted downhole. At the conclusion of the pressure tests, a pressure may be used (as described below) to reopen the ball valve 22.

For purposes of preventing unintentional opening and closing of the ball valve 22, the valve assembly 10 includes two index mechanisms 15 and 20, in some embodiments of the invention. The index mechanism 15 is pressure actuated and prevents the unintentional opening of the ball valve 22 without the occurrence of a predetermined number of pressurization/de-pressurization cycles, as described below. The index mechanism 20 is actuated via physical contact between the shifting tool 16 and the valve assembly 10 and prevents the unintentional closing of the ball valve 22 without a predetermined pattern of engagement, described below. Without the index mechanism 20, movement of the shifting tool 16 or movement of the string 30 itself may unintentionally engage the closing mechanism of the valve assembly 10 to cause the ball valve assembly 10 to attempt to prematurely close, a condition that may cause the string 30 to become jammed in the ball valve 22, thereby preventing the removal of the string 30 from the well.

More particularly, in some embodiments of the invention, the valve assembly 10 includes an operator mandrel 12 that moves up in response to applied tubing pressure (in the central passageway of the assembly 10) and moves down when the pressure is released. The downward travel of the mandrel 12 is limited by the index mechanism 15 until a predetermined number of cycles occur in which the tubing pressure increases and then decreases. After the predetermined number of cycles, the index mechanism 15 permits the mandrel 12 to travel downward to contact a collet actuator 13 that is engaged with a ball valve operator mandrel 14 that, in turn, operates the ball valve 22. In this manner, the downward movement of mandrel 12 causes the mandrel 14 to move in a downward direction to open the ball valve 22.

In some embodiments of the invention, to close the ball valve 22 via the shifting tool 16, the profile 17 of the shifting tool 16 engages (as described below) the collet actuator 13 to force the collet actuator 13 up and down. On each upward stroke, the collet actuator 13 disengages from the mandrel 14, as described below.

When the mandrel 14 moves up by a sufficient distance, the mandrel 14 closes the ball valve 22. However, the upward travel of the mandrel 14 is limited by the index mechanism 20 until the shifting tool 16 forces the collet actuator 13 up and down for a predetermined number of cycles. After the cycles occur, the mandrel 14 engages with the collet actuator 13 on the downstoke on the sleeve 13 and remains engaged with the collet actuator 13 on the upstroke of the collet actuator 13, thereby permitting the shifting tool 16 to lift the mandrel 14 up for a sufficient distance to close the ball valve 22.

Figure 2:
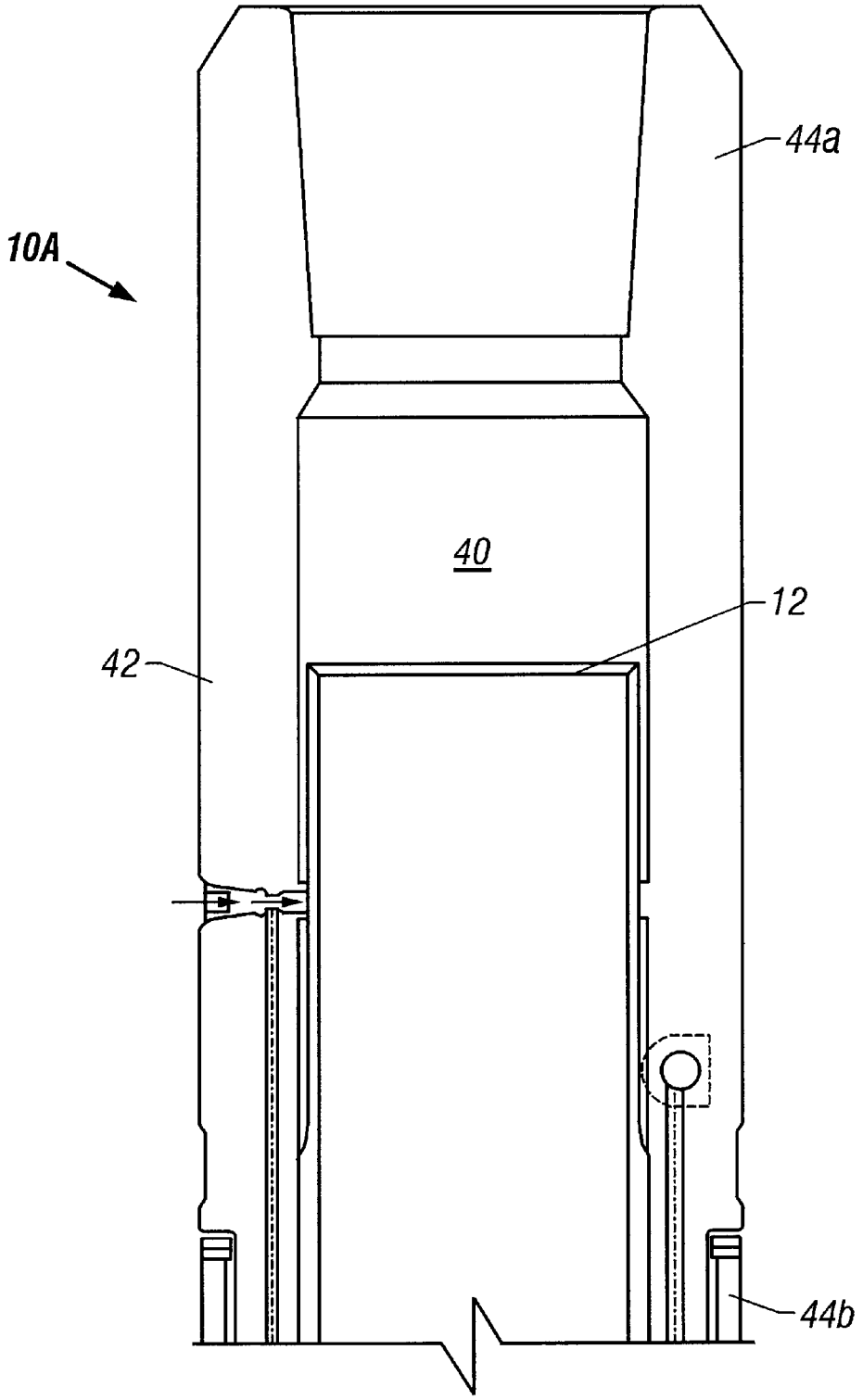
FIGS. 2, 3, 4, 6, 7 and 8 are more detailed schematic diagrams of sections of the formation isolation valve assembly according to an embodiment of the invention.
Figure 3:
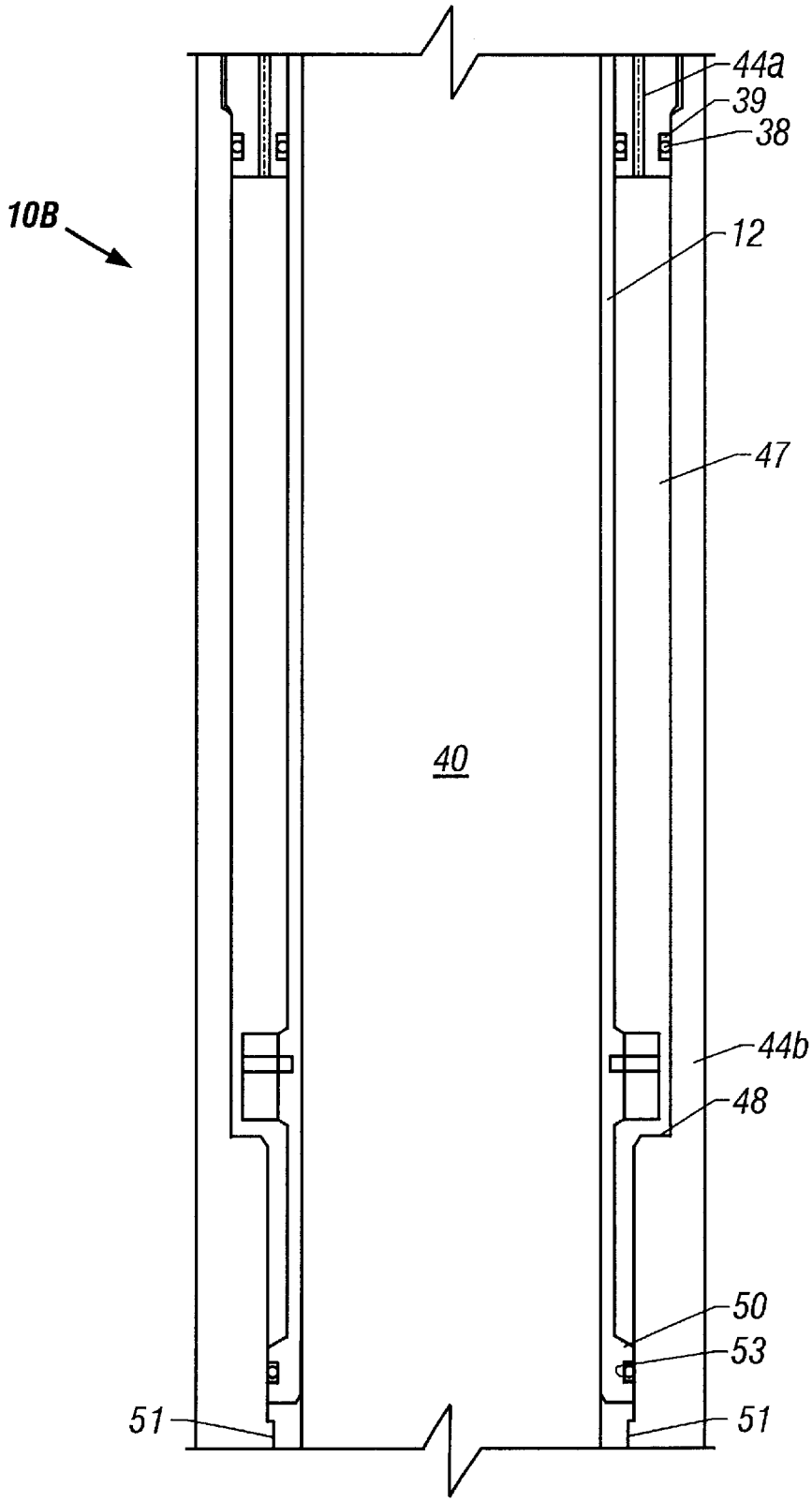
Figure 4:
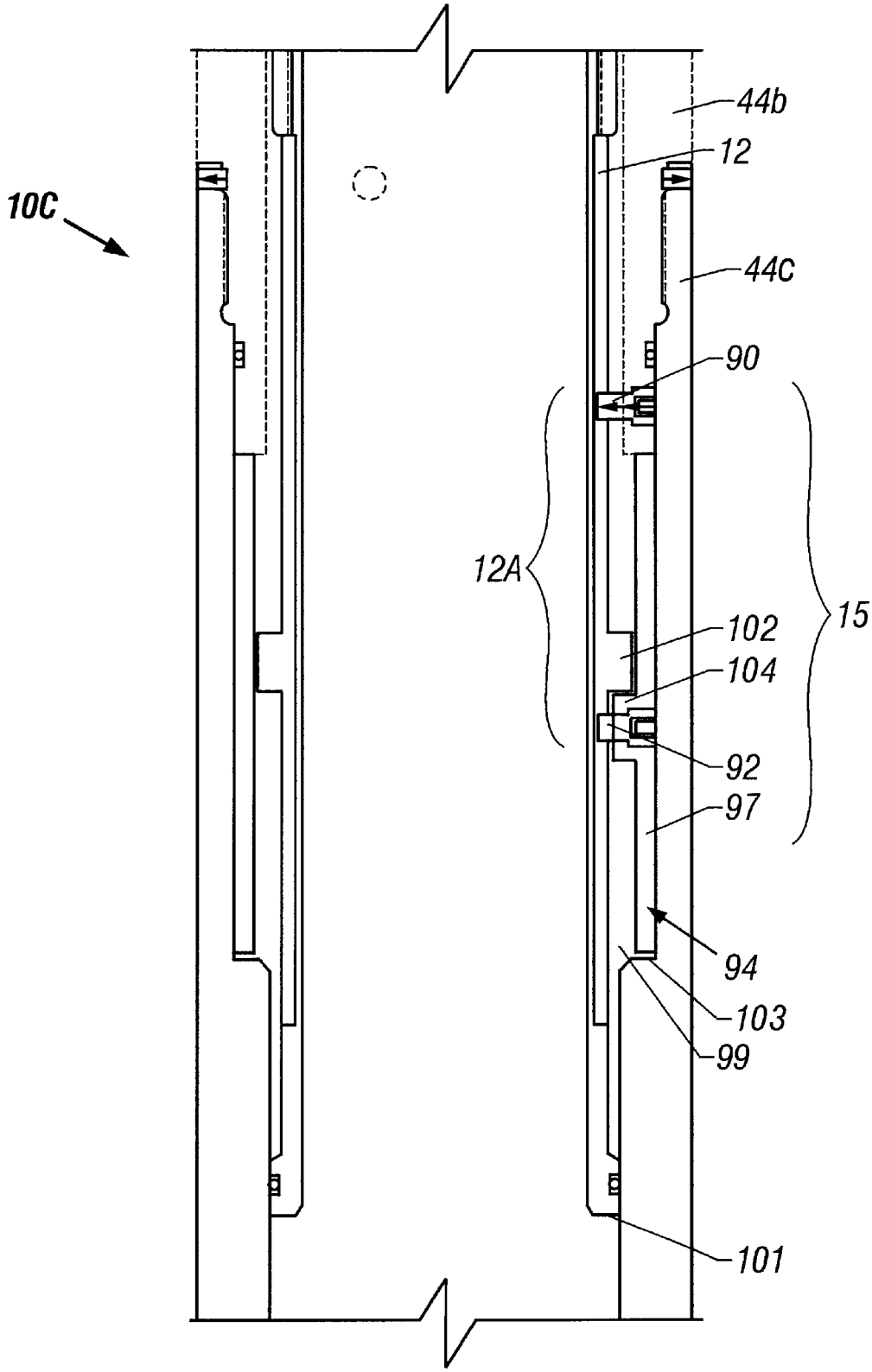

Referring to the formation isolation valve assembly 10 in more detail, FIGS. 2, 3 and 4 depict sections 10A, 10B and 10C that form a section (of the valve assembly 10) that houses the index mechanism 15 and the mandrel 12. The upper part of this section is formed from an upper housing section 44*a* that mates with a lower housing section 44*b*. In this manner, the lower end of the housing section 44*a* is received into a bore in the upper end of the housing section 44*b*. Both housing sections 44*a* and 44*b* are generally cylindrical and circumscribe a longitudinal axis of the valve assembly 10.

The mandrel 12 moves up in response to applied tubing pressure in a central passageway 40 of the valve assembly 10, and moves down in response to the pressure exerted by a nitrogen gas chamber 47 (FIG. 3). The nitrogen gas chamber 47, in some embodiments of the invention, is formed from an annularly recessed cavity located between the housing section 44*a* and the mandrel 12. The nitrogen gas chamber 47, in other embodiments of the invention, may be replaced by a coil spring or another type of spring, as examples.

The responsiveness of the mandrel 12 to the tubing pressure and the pressure that is exerted by the gas in the chamber 47 is attributable to an upper annular surface 50 (of the mandrel 12) that is in contact with the nitrogen gas in the nitrogen gas chamber 47 and a lower annular surface 51 of the mandrel 14 that is in contact with the fluid in the central passageway 40. Therefore, when the fluid in the central passageway 40 exerts a force (on the lower annular surface 51) that is sufficient to overcome the force that the gas in the chamber 47 exerts on the upper annular surface 50, a net upward force is established on the mandrel 12. Otherwise, a net downward force is exerted on the mandrel 12 to force the ball valve operator mandrel 14 down.

Referring to FIG. 4, the index mechanism 15 limits the upward and downward travel of the mandrel 12. More particularly, the index mechanism 15 confines the lower travel limit of the mandrel 12 until the mandrel 12 has made a predetermined number (eight or ten, as examples) of up/down cycles. In this context, an up/down cycle is defined as the mandrel 12 moving from a limited (set by the index mechanism 15) down position to a limited up position (set by the index mechanism 15) and then back down to the limited down position. A particular up/down cycle may be attributable to a pressure test in which the pressure in the central passageway 40 is increased and then after testing is completed, released.

After the mandrel 12 transitions through the predetermined number of up/down cycles, the index mechanism 15 no longer confines the downward travel of the mandrel 12. Therefore, when the central passageway 18 is pressurized again, the mandrel 12 is free to travel down to contact the mandrel 14 to open the valve 22.

Referring to FIG. 3, the mandrel 12 includes an exterior annular notch to hold O-rings 53 to seal off the bottom of the gas chamber 47. O-rings 39 are also located in an interior annular notch of the housing section 44*a* (see FIG. 3) to form a seal between the housing section 44*a* and the mandrel 12 to seal off the nitrogen gas chamber 47. O-rings 38 form a seal between the housing sections 44*a* and 44*b*.

Referring back to FIG. 4, in some embodiments of the invention, the index mechanism 15 includes an index sleeve 94 that is coaxial with the longitudinal axis of the valve assembly 10, circumscribes the mandrel 12 and is circumscribed by the housing section 44*c*. The index sleeve 94 includes a generally cylindrical body 97 that is coaxial with the longitudinal axis of the valve assembly 10 and is closely circumscribed by the housing section 44*c*. The index sleeve 94 includes protruding splines, or members 104 (one being shown in FIG. 4), that radially extend from the body 97 toward the mandrel 12 to serve as a stop to limit the downward travel of the mandrel 12 until the mandrel 12 moves through the predetermined number of up/down cycles.

More specifically, the protruding members 104 are radially spaced apart around the longitudinal axis of the valve assembly 10 so that when the index sleeve 94 is rotated to the appropriate position after the predetermined number of up/down cycles, radially spaced protruding members 102 (two being shown in FIG. 4) of the mandrel 12 that radially extend from the mandrel 12 toward the index sleeve 94 pass between the protruding members 104 of the index sleeve 94. Otherwise, the protruding members 104 limit the downward travel of the mandrel 12, as the protruding members 102 and 104 contact each other.

Each up/down cycle of the mandrel 12 rotates the index sleeve 94 about the longitudinal axis of the valve assembly 10 by a predetermined angular displacement. After the predetermined number of up/down cycles, the protruding members 102 of the mandrel 12 are completely misaligned with the protruding members 104 of the index sleeve 94, thereby allowing the mandrel 12 to pass through.

Figure 5:
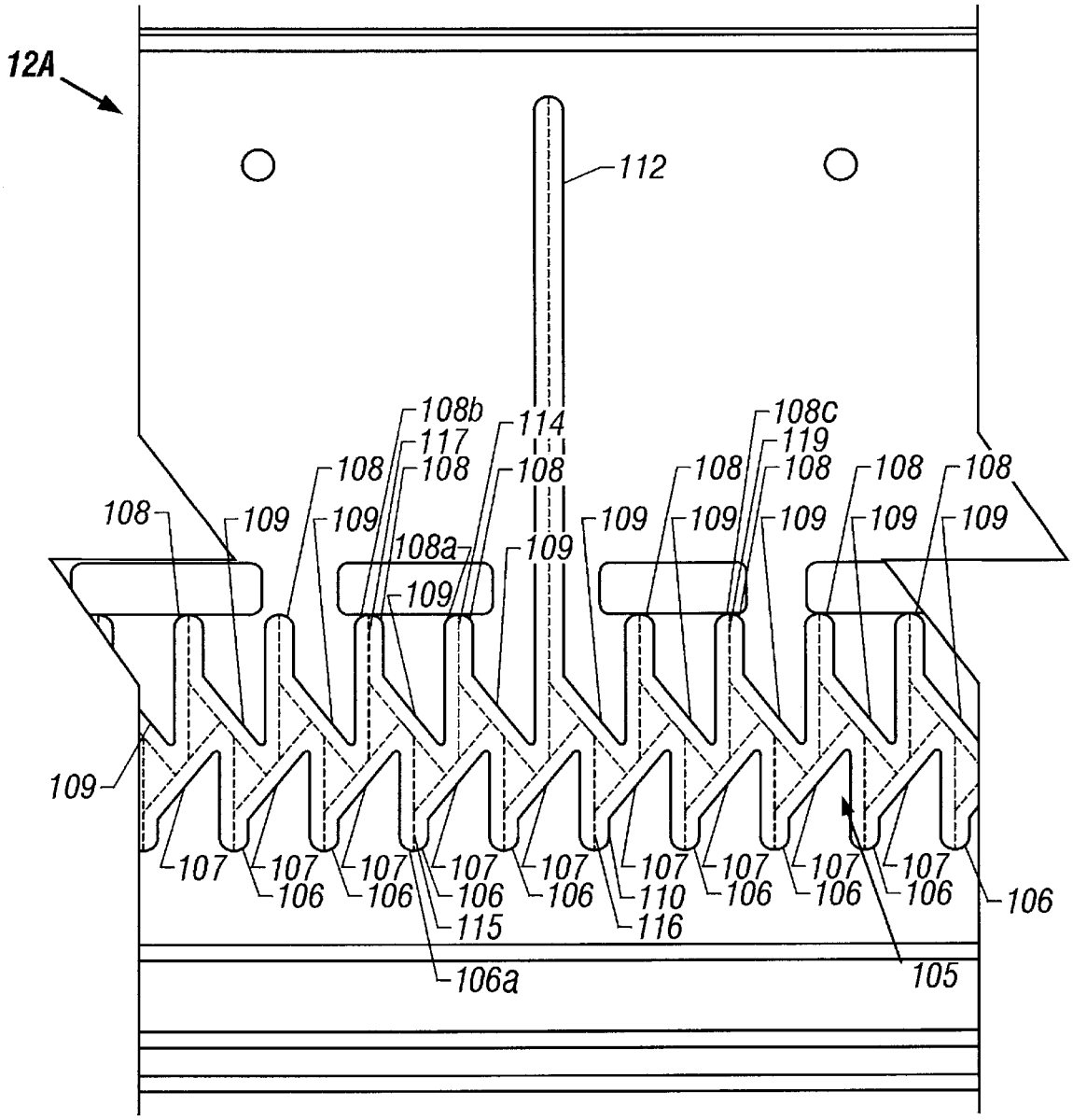
FIGS. 5 and 9 are schematic diagrams of flattened portions of the formation isolation valve assembly depicting J-slots according to different embodiments of the invention.

Referring both to FIG. 4 and FIG. 5 (that depicts a flattened portion 12A of the mandrel 12), in some embodiments of the invention, a J-slot 105 may be formed in the mandrel 12 to establish the indexed rotation of the index sleeve 94. In this J-slot arrangement, one end of an index pin 92 (see FIG. 4) is connected to the index sleeve 94. The index pin 92 extends through a particular protruding member 104 in a radially inward direction from the index sleeve 94 toward the mandrel 12 so that the other end of the index pin 92 resides in the J-slot 105. As described below, for purposes of preventing rotation of the mandrel 12, a pin 90 radially extends from the housing section 44*c* into a groove (of mandrel 12) that confines movement of the mandrel 12 to translational movement along the longitudinal axis of the valve assembly 10, as described below.

As depicted in FIG. 5, the J-slot 105 includes upper grooves 108 (grooves 108*a*, 108*b* and 108*c*, as examples) that are located above and are peripherally offset from lower grooves 106 (groove 106*a*, as an example) of the J-slot 105. All of the grooves 108 and 106 are aligned with the longitudinal axis of the valve assembly 10. The upper 108 and lower 106 grooves are connected by diagonal grooves 107 and 109. Due to this arrangement, each up/down cycle of the mandrel 12 causes the index pin 92 to move from the upper end of one of the upper grooves 108, through the corresponding diagonal groove 107, to the lower end of one of the lower grooves 106 and then return along the corresponding diagonal groove 109 to the upper end of another one of the upper grooves 108. The traversal of the path by the index pin 90 causes the index sleeve 94 to rotate by a predetermined angular displacement.

The following is an example of the interaction between the index sleeve 94 and the J-slot 105 during one up/down cycle. In this manner, before the mandrel 12 transitions through any up/down cycles, the index pin 92 resides at a point 114 that is located near the upper end of the upper groove 108*a*. Subsequent pressurization of the fluid in the central passageway 18 causes the mandrel 12 to move up and causes the index sleeve 94 to rotate. More specifically, the rotation of the index sleeve 94 is attributable to the translational movement of the index pin 92 with the mandrel 12, a movement that, combined with the produced rotation of the index sleeve 94, guides the index pin 92 through the upper groove 108*a*, along one of the diagonal grooves 107, into a lower groove 106*a*, and into a lower end 115 of the lower groove 106*a* when the mandrel 12 has moved to its farther upper point of travel. The downstroke of the mandrel 12 causes further rotation of the index sleeve 94. This rotation is attributable to the downward translational movement of the mandrel 12 and the produced rotation of the index sleeve 94 that guide the index pin 92 from the lower groove 106*a*, along one of the diagonal grooves 109 and into an upper end 117 of an upper groove 108*b*. The rotation of the index sleeve 94 on the downstroke of the mandrel 12 completes the predefined angular displacement of the index sleeve 94 that is associated with one up/down cycle of the mandrel 12.

At the end of the predetermined number of up/down cycles of the mandrel 12, the index pin 92 rests near an upper end 119 of the upper groove 108*c*. In this manner, on the next up stroke, the index pin 92 moves across one of the diagonal grooves 107 down into the lower end 116 of a lower groove 110. The resulting rotation of the index sleeve 94 causes the protruding members 102 of the mandrel 12 to become completely misaligned with the protruding members 104 of the index sleeve 94. Therefore, on the subsequent downstroke, the index pin 92 effectively travels up into the upper groove 112 as the mandrel 14 travels in a downward direction to open the packer isolation valve.

The index pin 90 (see also FIG. 4) always travels in the upper groove 112. Because the index pin 90 is secured to the housing section 19, this arrangement keeps the mandrel 12 from rotating during the rotation of the index sleeve 94.

Figure 6:
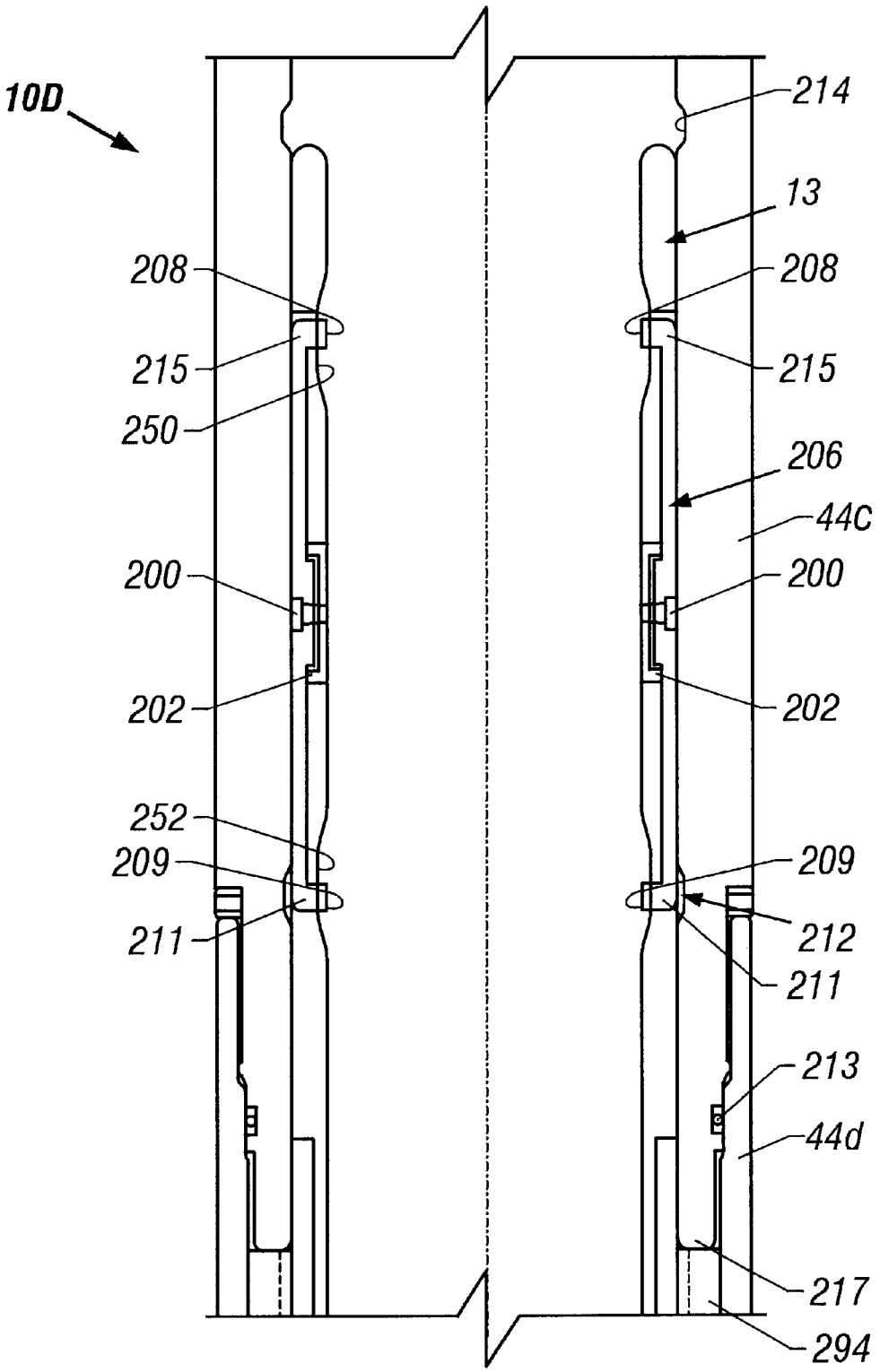
Figure 7:
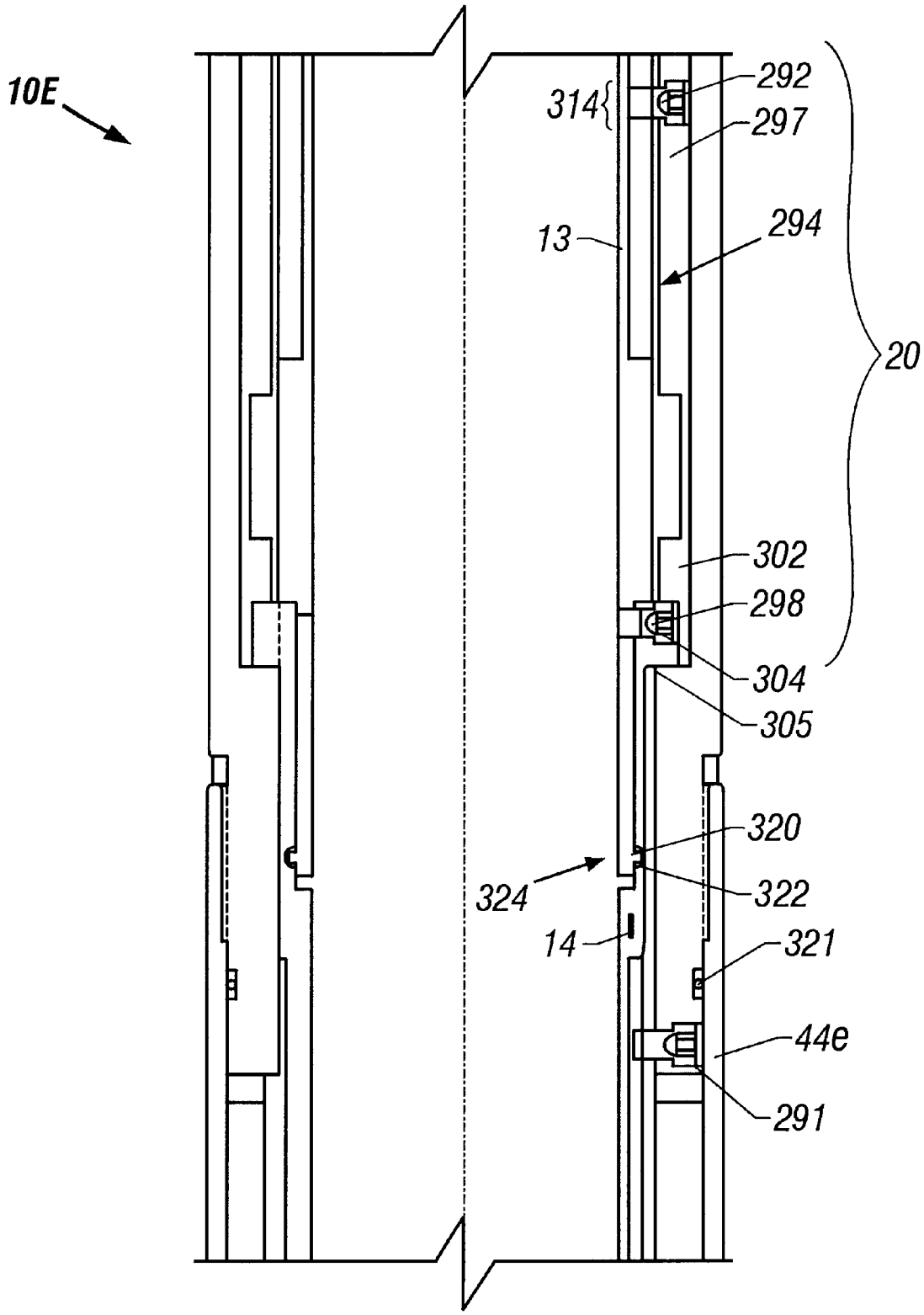

FIGS. 6 and 7 depict sections 10D and 10E (of the valve assembly 10) that include the collet actuator 13, the ball valve operator mandrel 14 and the index mechanism 20. The sections 10D and 10E are formed by the housing sections 44*c*, 44*d* and 44*e*, each of which circumscribes the longitudinal axis of the valve 20. In this manner, the lower end of the housing section 44*c* is received by a bore located in the upper end of the housing section 44*d*. The housing sections 44*c* and 44*d* are sealed together via O-rings 213 that are located in an exterior annular notch of the housing section 44*c*. The lower end of the housing section 44*d* is received by a bore located in the upper end of the housing section 44*d*. The housing sections 44*d* and 44*e* are sealed together via O-rings 321 that are located in an exterior annular notch of the housing section 44*d*.

In some embodiments of the invention, when the shifting tool 16 closes the ball valve 22 (after gravel packing operations, for example), the collet actuator 13 is engaged with the mandrel 14 and has a higher position than depicted in FIGS. 6 and 7. In this higher position, the mandrel 14 closes the ball valve 22 and subsequent action by the mandrel 12 is required to open the ball valve 22. More specifically, a collet sleeve 206 is mounted to the collet actuator 13 to lock the collet actuator 13 and mandrel 14 (that is at this point engaged with the mandrel 14) into a position that keeps the ball valve 22 closed until the mandrel 12 forces the collet actuator 13 and mandrel 14 in a downward direction at the end of pressure testing operations, as described above.

The collet sleeve 206 is attached to the collet actuator 13 via a pin 200, circumscribes a portion of the collet actuator 13, and is located between the collet actuator 13 and the housing section 44*c*. When the collet actuator 13 is in its upper position in which the ball valve 22 is closed, the ends of upper fingers 215 of the collet sleeve 206 are located in an annular notch 214 that is formed in an interior surface of the housing section 44*c*. However, when the collet actuator 13 is forced in a downward direction, the beveled profile of the notch 214 causes the upper fingers 215 to be forced out of the notch 214 and extend through openings 208 of the collet actuator 13, thereby permitting the collet actuator 13 and mandrel 14 to travel down.

However, before the mandrel 14 may move freely to close the ball valve 22 after gravel packing operations are complete, the index mechanism 20 is engaged to prevent unintentional closing of the ball valve 22 on the string 30. A predetermined number of up and down cycles of the collet actuator 13 disengages the index mechanism 20 so that the mechanism 20 no longer restricts travel of the mandrel 14.

Referring to FIG. 7, thus, when the index mechanism 20 is engaged and the ball valve 22 is open, the index mechanism's restriction on the upward travel of the mandrel 14 causes the collet actuator 13 to disengage, or separate, from the mandrel 14 on upstrokes until the collet 13 cycles through the predetermined number of up/down cycles.

To regulate the closing of the ball valve 22, the index mechanism 20 includes an index sleeve 294. The index sleeve 294 is coaxial with the longitudinal axis of the valve assembly 10, circumscribes the collet actuator 13 and is circumscribed by the housing section 44*d*. The index sleeve 294 is prevented from upward and downward movement via a lower shoulder 217 (see FIG. 6) of the housing section 44*c* and a shoulder 305 (see FIG. 7) of the housing section 44*d*. The index sleeve 294 includes a generally cylindrical body 297 that is coaxial with the longitudinal axis of the valve assembly 10 and is closely circumscribed by the housing section 44*d*. The index sleeve 294 includes protruding splines, or members 302 (one being shown in FIG. 7), that radially extend inwardly from the body 297 to serve as a stop to limit the upward travel of the mandrel 14 until the shifting tool 16 moves the collet actuator 13 up and down a predetermined number of times. The downward travel of the mandrel 14 is limited by the shoulder 305 of the housing section 44*d*.

More specifically, the protruding members 302 are radially spaced apart so that when the index sleeve 294 is rotated to the appropriate position, radially spaced protruding members 304 (of the mandrel 14) that extend radially outwardly from the mandrel 14 toward the index sleeve 294 pass between the protruding members 302 of the index sleeve 294. When the mandrel 14 is pulled up with the collet actuator 13 to close the ball valve 22, the index sleeve 294 is positioned to allow the protruding members 304 to pass between the protruding members 302, as described below. In one embodiment, the protruding members 302, 304 remain thus aligned to allow the subsequent axial movement of mandrel 14.

Each time the shifting tool 16 moves the collet actuator 13 up or down, the index sleeve 294 rotates about the longitudinal axis of the valve assembly 10 by a predetermined angular displacement. After the predetermined number of up and down movements by the collet actuator 13, the protruding members 304 of the mandrel 14 are completely misaligned with the protruding members 302 of the index sleeve 294, thereby allowing the mandrel 14 to pass through to move in an upward direction to close the ball valve 22.

Figure 9:
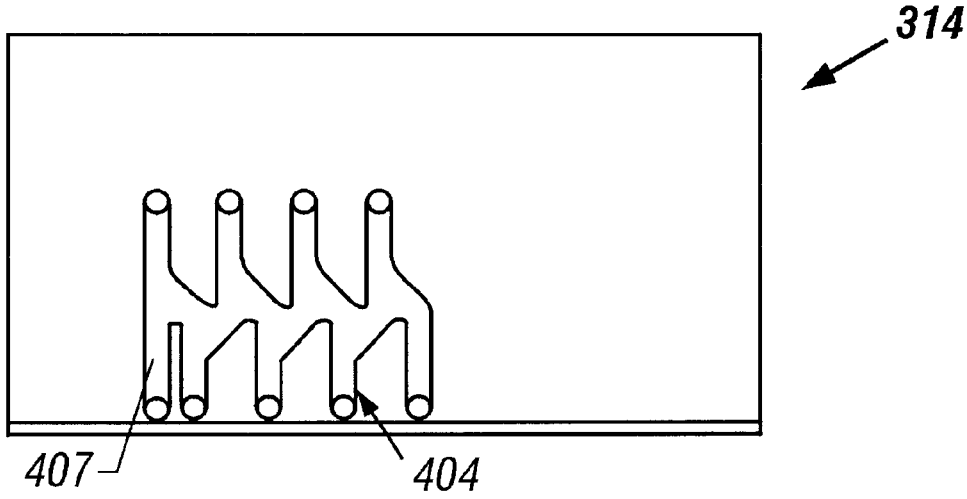

In some embodiments of the invention, a J-slot 404 (see also FIG. 9 that depicts a flattened portion 314 of the collet actuator 13) may be formed in the collet actuator 13 to establish the indexed rotation of the index sleeve 294. In this J-slot arrangement, one end of an index pin 292 (see FIG. 7) is connected to the index sleeve 294. The index pin 292 extends radially inwardly so that the other end of the index pin 292 resides in the J-slot 404 in the collet actuator 13. For purposes of preventing rotation of the collet actuator 13, a pin 291 radially extends from the housing section 44*d* into a longitudinal groove of the mandrel 14, and a pin 298 radially extends inwardly from the mandrel 14 into a longitudinal groove of the collet actuator 13. Thus, the pin 291 confines movement of the mandrel 14 to translational movement along the longitudinal axis of the valve assembly 10, and the pin 298 confines movement of the collet actuator 13 to the translational movement along the longitudinal axis of the valve assembly 10.

Therefore, due to the above-described arrangement, each time the collet actuator 13 moves in a downward direction, the index sleeve 294 rotates by a predetermined angular displacement, and each time the collet actuator 13 moves in an upward direction, the index sleeve 294 rotates by a predetermined displacement. Eventually, the index sleeve 294 does not restrict the upward travel of the mandrel 14 and permits the mandrel 14 to be pulled up enough to close the ball valve 22.

Referring to FIG. 6, for purposes of allowing the shifting tool 16 to engage the collet actuator 13 to move the collet actuator 13 up and down, the collet actuator 13 has an interior annular upper groove 250 and an interior annular lower groove 252 that each have beveled cross-sections. The upper groove 250 has the openings 208 (two being depicted in FIG. 6) through which the end of the upper fingers 215 of the collet sleeve 206 extend to catch the shifting tool 16 to permit the tool 16 to lift the collet actuator 13 to the height that is allowed by the index pin 292. When the collet actuator 13 travels in an upward direction, the upper fingers 215 are received by an upper annular groove 214 formed on the interior surface of the housing section 44*c*. When received by the groove 214, the upper fingers 215 retract to release the grip on the shifting tool 16. The lower groove 252 has openings 209 (two being depicted in FIG. 6) through which the ends of lower fingers 211 of the collet sleeve 206 extend to catch the shifting tool 16 to permit the tool 16 to shift the collet actuator 13 back down. When the collet actuator 13 travels in a downward direction, the lower fingers 211 are received by an annular groove 212 that is formed in the interior surface of the housing section 44*c*. When received by the groove 212, the lower fingers 211 retract to release their grip on the shifting tool 16.

Figure 8:
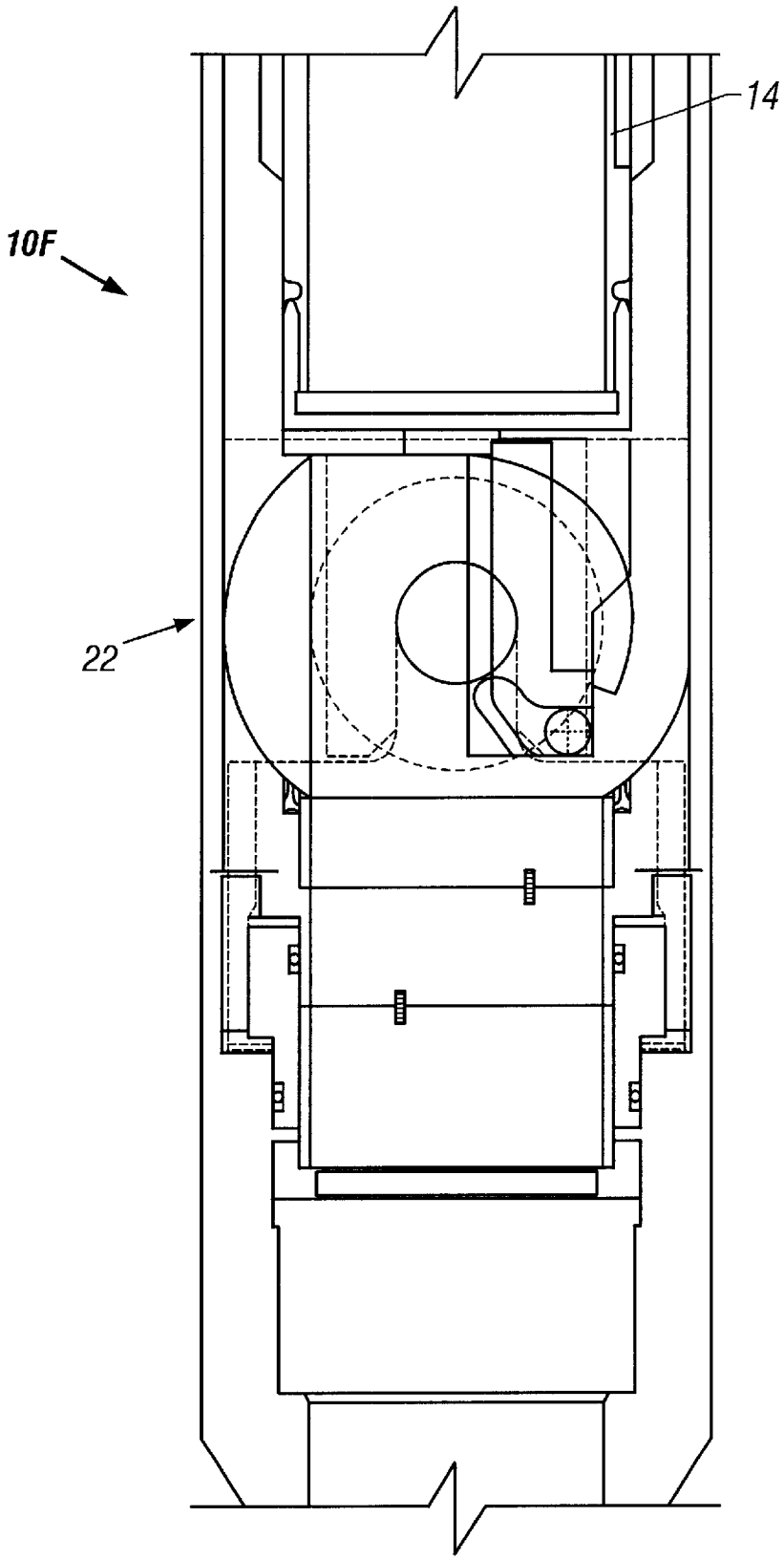

Referring to FIGS. 7 and 8, in some embodiments of the invention, the collet actuator 13 includes fingers, such as a finger 324 that is depicted in FIG. 7, that includes an exterior annular ridge 320 that is received by a corresponding beveled interior annular notch 322 of the mandrel 14. Thus, as long as the index sleeve 294 restricts the upward travel of the mandrel 14, the upward force that is applied on the collet actuator 13 by the shifting tool 16 dislodges the collet actuator 13 from the mandrel 14 and allows the collet actuator 13 to proceed upwardly by itself. When the collet actuator 13 is one again moved downwardly by the shifting tool 16, the exterior annular ridge 320 is once again received by the annular notch 322. As depicted in FIG. 8, the mandrel 14 extends to operate the ball valve 22 that is housed in a lower section 10F of the valve assembly 10.

Once the index pin 292 enters the final, longitudinal groove 407 (see FIG. 9) of the J-slot 404, the index sleeve 294 no longer restricts the upward travel of the mandrel 14. Thus, the ridge 320/notch 322 connection will not disengage when the collet actuator 13 is moved upward (or downward), and the upward movement of the collet actuator 13 also results in the upward movement of mandrel 14. Based on the now "fixed" connection between the mandrel 14 and collet actuator 13, the shifting tool 16 may be used to close the ball valve 22 by pulling the collet actuator 13 up and open the ball valve by shifting the collet actuator 13 down, as the index mechanism 20 is effectively disabled after cycling once through the above-described sequence. It is noted that the J-slot 404 may be designed to require any number of up/down cycles by the collet actuator 13 before releasing the mandrel 14, as can be appreciated by those skilled in the art.

In summary, in some embodiments of the invention, the valve assembly 10 may be run downhole with the ball valve 22 in the open state, with a string 30, including a shifting tool 16, disposed through the ball valve 22. The string 30 is used to conduct an operation (like gravel packing) below the ball valve 22. When the operation is completed, the string 30 is pulled up and the shifting tool 16 engages the collet actuator 13. Due to the presence of the index mechanism 20, movement of the mandrel 14 is initially restricted. In order to move mandrel 14 to close the ball valve 22, the shifting tool 16 must be used to move the collet actuator 13 up and down the predetermined number of times until the index mechanism 20 is disengaged. Once the index mechanism 20 is disengaged, the shifting tool 16 pulls the collet actuator 13 and mandrel 14 upward closing the ball valve 22. The string 30 is then removed from the wellbore. By requiring the predetermined number of times, the index mechanism 20 prevents the inadvertent and/or premature closure of the ball valve 22.

At this point, index mechanism 20 is disengaged (with index pin 292 always subsequently riding in groove 407) and the mandrel 14 can be forced down by the mandrel 12. The operator may at this point wish to pressure test the tubing string above the ball valve 22 or perform other pressure-responsive operations. Due to the presence of index mechanism 15, movement of the mandrel 12 is initially restricted. As such, the pressure cycles will not act to open the ball valve 22 until after the predetermined number of pressure cycles have been performed. After the last of the predetermined pressure cycles, the index mechanism 15 disengages, allowing mandrel 12 to move downward, act on collet actuator 13, and move collet actuator 13 and mandrel 14 (since index mechanism 20 is also disengaged) to open ball valve 22. Once both index mechanisms 15, 20 are disengaged, the ball valve 22 may be opened or closed through the engagement between shifting tool 16 and collet actuator 13. At this point, one shift down will normally open ball valve 22, and one shift up will normally close ball valve 22.

Although the use of the mandrel 12 and the predetermined number of pressurization/de-pressurization cycles are described above for opening the ball valve 22 after the pressure tests, the ball valve 22 may also be opened via the shifting tool 16. In some embodiments of the invention, the index mechanisms 15 and 20 may be disengaged in a reverse order to that described above. In this manner, in some embodiments of the invention, the pressurization/de-pressurization cycles may be used to open and/or close the ball valve 22 before the shifting tool 16 is used in connection with the up and downstrokes of the collet actuator 13. Other variations are possible.

Figure 10:
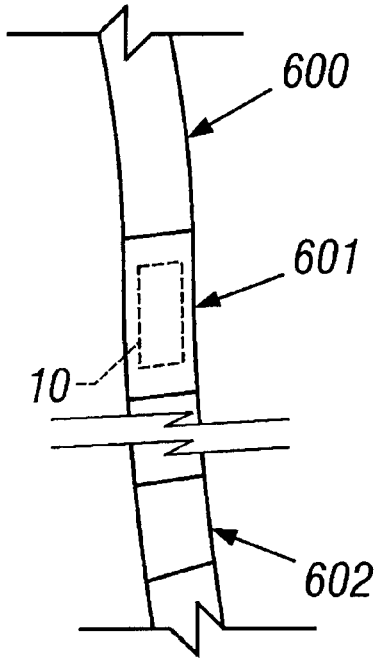
FIG. 10 is a schematic diagram of a portion of a production tubing according to an embodiment of the invention.

Referring to FIG. 10, in some embodiments of the invention, the valve assembly 10 may be located inside a production tubing 600. As shown, the valve assembly 10 is located closer to the surface of the well than a port closure sleeve 602 (of the production tubing 600) that is located downhole from the valve assembly 10. For the vertical arrangement depicted in FIG. 10, the valve assembly 10 is located above, or uphole from, the sleeve 602.

This relationship between the valve assembly 10 and sleeve 602 may be particularly advantageous for use with gravel packing operations. In this manner, the port closure sleeve 602 includes radial ports that may be opened for purposes of a gravel packing operation, an operation in which a gravel packing tool (not shown) may be extended through the valve assembly 10 and positioned near the port closure sleeve 602 so that gravel may be introduced around the exterior of the production tubing 600. After the completion of the gravel packing operation, the gravel packing tool may then be withdrawn through the valve assembly 10.

It is possible that the introduction of gravel through the radial ports of the sleeve 602 may compromise the seal integrity of sleeve 602. For example, when the sleeve 602 is supposed to be closed to seal off the internal passageway of the production tubing 600 from receiving fluid from outside of the tubing 600, debris that is introduced by the gravel packing operation may keep the sleeve 602 from forming a tight seal when closed.

However, because the valve assembly 10 is located between the sleeve 602 and the surface of the well, the valve assembly 10 may be closed to perfect the seal that may otherwise not be provided by the sleeve 602. Thus, the location of the valve assembly 10 above the sleeve 602 circumvents potential sealing problems that may occur with the use of the sleeve 602.

In the preceding description, directional terms, such as "upper," "lower," "vertical," "horizontal," etc., may have been used for reasons of convenience to describe the isolation valve and its associated components. However, such orientations are not needed to practice the invention, and thus, other orientations are possible in other embodiments of the invention.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. An assembly usable in a subterranean well, comprising:

a valve adapted to selectively isolate a region of the well;

a sleeve adapted to be moved by a downhole tool to cause the valve to transition from a first state to a second state, the downhole tool being part of a string that is separate from the valve; and an index mechanism to prevent the valve from transitioning from the first state to the second state until after a position of the sleeve follows a predefined pattern.

2. The assembly of claim 1, wherein the sleeve is further adapted to be moved in response to a pressure.

3. The assembly of claim 2, further comprising:

another index mechanism to prevent the valve from transitioning from the second state to the first state until the pressure follows another predefined pattern.

4. The assembly of claim 3, wherein the first state comprises an open state and the second state comprises a closed state.

5. The assembly of claim 1, wherein the first state comprises an open state and the second state comprises a closed state.

6. The assembly of claim 1, wherein the string is capable of extending through the valve when the valve is open.

7. The assembly of claim 1, wherein the index mechanism prevents the valve from unintentionally transitioning from the first state to the second state.

8. The assembly of claim 1, wherein the assembly comprises a formation isolation valve assembly.

9. The assembly of claim 1, wherein the index mechanism comprises:

an index sleeve to limit travel of the mandrel until the index sleeve is rotated to a predefined position;

a pin connected to the index sleeve; and a groove formed in the first sleeve to rotate the index sleeve to the predefined position in response to the position of the first sleeve following the predefined pattern.

10. The assembly of claim 1, wherein the predefined pattern comprises a predefined number of cycles of the sleeve, each cycle including one upstroke of the mandrel and one downstroke of the sleeve.

11. The assembly of claim 1, wherein the index mechanism prevents the valve from unintentionally transitioning from the first state to the second state due to movement of a string attached to the tool.

12. The assembly of claim 1, wherein the valve comprises a ball valve.

13. The assembly of claim 1, further comprising:

a mandrel adapted to be operated by pressure to move the sleeve.

14. The assembly of claim 13, further comprising:

another index mechanism to prevent the mandrel from moving the sleeve until the pressure conforms to a predetermined pressure pattern.

15. The assembly of claim 13, wherein the movement of the sleeve by the mandrel transitions the valve from the second state to the first state.

16. A method comprising:

using a valve to isolate a region of a subterranean well;

moving a sleeve with a downhole tool to cause the valve to transition from a first state to a second state, the downhole tool being part of a string that is separate from the valve; and preventing the valve from transitioning from the first state to the second state until after a position of the sleeve follows a predefined pattern.

17. The method of claim 16, further comprising:

applying pressure downhole;

preventing the sleeve from moving from the second state to the first state until the pressure follows another predefined pattern.

18. The method of claim 17, wherein the first state comprises an open and the second state comprises a closed state.

19. The method of claim 16, wherein the first state comprises an open state and the second state comprises a closed state.

20. The method of claim 16, wherein the string is capable of extending through the valve when the valve is open.

21. The method of claim 16, wherein the preventing comprises preventing the valve from unintentionally transitioning from the first state to the second state.

22. The method of claim 16, wherein the assembly comprises a formation isolation valve assembly.

23. The method of claim 16, wherein the predefined pattern comprises a predefined number of cycles of the sleeve, each cycle including one upstroke of the sleeve and one downstroke of the sleeve.

24. The method of claim 16, wherein the preventing comprises preventing the valve from unintentionally transitioning from the first state to the second state due to movement of a string attached to the tool.

25. The method of claim 16, further comprising:

using pressure to operate a mandrel to move the sleeve.

26. The method of claim 25, further comprising:

preventing the mandrel from moving the sleeve until the pressure conforms to a predetermined pressure pattern.

27. The method of claim 25, wherein the movement of the sleeve by said mandrel transitions the valve from the second state to the first state.

28. The method of claim 16, further comprising:

positioning the valve between a port closure sleeve and the surface of the well.

29. The method of claim 28, wherein the positioning the valve comprises:

positioning the valve uphole from the port closure sleeve.

30. An assembly comprising:

a valve adapted to transition between first and second states;

a first index mechanism functionally connected to the valve to prevent the valve from transitioning from the first state to the second state; and a second index mechanism separate from the first index mechanism and functionally connected to the valve to prevent the valve from transitioning from the second state to the first state.

31. The assembly of claim 30, wherein the first index mechanism comprises a movement responsive index mechanism.

32. The assembly of claim 31, wherein the second index mechanism comprises a pressure responsive index mechanism.

33. The assembly of claim 30, wherein the second index mechanism comprises a pressure responsive index mechanism.

34. A method comprising:

running a valve open into a wellbore;

shifting a tool that is part of a string that is separate from the valve a predetermined number of times to close the valve; and increasing a pressure inside a tubing bore a predetermined number of times to open the valve.

35. A system usable with a subterranean well, comprising:

a tubular string;

a port closure sleeve being part of the tubular string to selectively control fluid between an inner passageway of the string and a region outside of the string;

a valve being part of the string and adapted to selectively isolate a region of the well, the valve being located between the port closure sleeve and the surface of the well;

a second sleeve adapted to be moved by a downhole tool to cause the valve to transition from a first state to a second state, the downhole tool being part of a string that is separate from the valve; and an index mechanism to prevent the valve from transitioning from the first state to the second state until after a position of the second sleeve follows a predefined pattern.

36. The system of claim 35, wherein the port closure sleeve is located uphole from the valve.

37. The system of claim 35, wherein the sleeve is further adapted to be moved in response to a pressure.

38. The system of claim 37, further comprising:

another index mechanism to prevent the valve from transitioning from the second state to the first state until the pressure follows another predefined pattern.

39. The system of claim 38, wherein the first state comprises an open state and the second state comprises a closed state.

40. The system of claim 35, wherein the first state comprises an open state and the second state comprises a closed state.

41. The system of claim 35, wherein the string is capable of extending through the valve when the valve is open.

42. The system of claim 35, wherein the index mechanism prevents the valve from unintentionally transitioning from the first state to the second state.

43. The system of claim 35, wherein the system comprises a formation isolation valve system.

44. The system of claim 35, wherein the index mechanism comprises:

an index sleeve to limit travel of the mandrel until the index sleeve is rotated to a predefined position;

a pin connected to the index sleeve; and a groove formed in the first sleeve to rotate the index sleeve to the predefined position in response to the position of the first sleeve following the predefined pattern.

45. The system of claim 35, wherein the predefined pattern comprises a predefined number of cycles of the sleeve, each cycle including one upstroke of the mandrel and one downstroke of the sleeve.

46. The system of claim 35, wherein the index mechanism prevents the valve from unintentionally transitioning from the first state to the second state due to movement of a string attached to the tool.

47. The system of claim 35, wherein the valve comprises a ball valve.

48. The system of claim 35 further comprising:

a mandrel adapted to be operated by pressure to move the sleeve.

49. The system of claim 48, further comprising:

another index mechanism to prevent the mandrel from moving the sleeve until the pressure conforms to a predetermined pressure pattern.

* * * * *